US008782895B2

(12) United States Patent
Fukumoto

(10) Patent No.: US 8,782,895 B2
(45) Date of Patent: Jul. 22, 2014

(54) METHOD OF MANUFACTURING DROPLET EJECTION HEAD

(75) Inventor: Yoshiyuki Fukumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 13/293,446

(22) Filed: Nov. 10, 2011

(65) Prior Publication Data

US 2012/0120155 A1 May 17, 2012

(30) Foreign Application Priority Data

Nov. 17, 2010 (JP) ..... 2010-256863

(51) Int. Cl.
*B41J 2/145* (2006.01)
*B41J 2/16* (2006.01)

(52) U.S. Cl.
USPC ..... 29/890.1; 29/611; 29/830; 29/831; 156/273.7; 156/285; 156/321; 347/47; 347/56

(58) Field of Classification Search
USPC ..... 29/890.1, 611, 25.35, 830, 831; 156/272.2, 273.7, 285, 321; 347/44, 347/47, 54, 56
See application file for complete search history.

(56) References Cited

U.S. PATENT DOCUMENTS 6,305,080 B1 * 10/2001 Komuro et al. ..... 29/890.1
2009/0250162 A1 * 10/2009 Rivas et al. ..... 156/272.2

FOREIGN PATENT DOCUMENTS

JP 04339662 A * 11/1992 ..... 29/890.1
JP 11-334079 A 12/1999
JP 2001-18392 A 1/2001

* cited by examiner

*Primary Examiner* — A. Dexter Tugbang
(74) *Attorney, Agent, or Firm* — Fitzpatrick, Cella, Harper & Scinto

(57) ABSTRACT

In a method for manufacturing a droplet ejection head, a structure of a substrate having an energy-generating element that imparts energy to a liquid to eject a liquid droplet from an ejection orifice and an orifice plate having the ejection orifice formed therein are laminated through a flow channel member for forming a pattern of a liquid flow channel that is a region in which the liquid flows. At least one of a plate before being laminated and the flow channel member before being laminated has a void of at least one of a through-hole other than the ejection orifice and a recess in the face to be laminated.

13 Claims, 7 Drawing Sheets

METHOD OF MANUFACTURING DROPLET EJECTION HEAD

BACKGROUND OF THE INVENTION

1. Field of the Invention

The present invention relates to a droplet ejection head such as an ink jet recording head, and a method for manufacturing the same.

2. Description of the Related Art

A droplet ejection head is used in a wide range of applications such as a printer, an apparatus for manufacturing a display component and a medical inhaler, and is expected to be applied to many industries in the future as well. As a droplet ejection head used in a printer, an ink jet recording head is used which can eject a droplet with high density and high accuracy.

The ink jet recording head has a head structure such as electric wires and an ejection orifice for ejecting an ink droplet therethrough provided on a substrate made of silicon or the like. The head structure includes an ink flow channel through which ink flows on a substrate, a flow channel member for surrounding the ink flow channel, an orifice plate provided with an ejection orifice and an energy-generating element for imparting energy to the ink and thereby ejecting an ink droplet from the ejection orifice. The substrate having such a head structure provided thereon is hereinafter referred to as a head substrate.

The energy-generating element includes an electrothermal transducer (heater element) for boiling a liquid, and a piezo element for imparting a pressure to a liquid by virtue of change in volume. The flow channel member and the orifice plate include those prepared by patterning an organic thin film or an inorganic thin film using a photolithographic process.

To manufacture an ink jet recording head, a method is commonly used which involves laminating an orifice plate with a head substrate having a flow channel member formed thereon through a flow channel member. Japanese Patent Application Laid-Open No. H11-334079 and Japanese Patent Application Laid-Open No. 2001-18392 are mentioned as prior art documents.

When the orifice plate is laminated with the head substrate, at least one of the flow channel member and the orifice plate is formed from a material having adhesiveness, and both the orifice plate and head substrate are bonded to each other by a pressure bonding method. FIGS. 8A and 8B illustrate a sectional view for describing a conventional process for manufacturing an ink jet recording head. As in FIG. 8A, an orifice plate 2 having the ejection orifice 4 formed thereon is aligned with a head substrate 30 having a flow channel member 3 and an energy-generating element 7 formed on a substrate 1, and in FIG. 8B, the orifice plate 2 is pressure-bonded to the head substrate 30 with a thermocompression bonding machine or the like.

In addition, an adhesive may be applied onto the surface of the flow channel member 3 or the orifice plate 2, and then the adhesive may be caused to develop its adhesiveness by heating or UV radiation, and the orifice plate 2 and flow channel member 3 may be bonded to each other under pressure applied. Furthermore, an elastic body member, such as rubber, may be inserted into between the pressure bonding part of the thermocompression bonding machine and a sample (orifice plate 2 and head substrate 30) to enhance the uniformity of pressure bonding.

The thermocompression bonding operation shown in FIGS. 8A and 8B is conducted for the purpose of bonding the orifice plate 2 with the flow channel member 3. Process conditions in pressure bonding include a pressure-bonding period of time, a pressure-bonding temperature and a pressure-bonding pressure. These conditions are determined according to the bonding conditions of the adhesive used.

However, in some of the ink jet recording heads manufactured by such a manufacturing method, there have been cases where the flow channel member and the orifice plate are not ideally bonded to each other and such a phenomenon occurs where the orifice plate locally protrudes toward an ejection direction. On the other hand, there also have been cases where such a phenomenon occurs where the orifice plate protrudes toward the side of the flow channel member.

If such a flexure occurs in the orifice plate, the ejection direction of the droplet occasionally results in tilting from the desired direction to which the droplet should be ideally ejected. In addition, there are cases where the ejection speed and the volume of the droplet to be ejected results in changing because the energy of the droplet necessary for ejection changes. These phenomena are crucial because of causing a print pattern failure of the printer.

Such a flexure of an orifice plate is a phenomenon which may occur also in a droplet ejection head in applications other than the printer. When this phenomenon has occurred, for instance, in the medical inhaler, in some cases, the ejection amount of the medicine to be inhaled by a patient may be changed as a result.

In addition, it is important from the viewpoint of enhancing the performance of the printer to reduce the power consumption of the ink jet recording head. In order to reduce the power consumption of the ink jet recording head, it is effective to minimize the thickness of the orifice plate to thereby reduce the fluid resistance of the ejection orifice and to lower the energy necessary for ejection. However, the orifice plate has a tendency of decreasing its rigidity as it becomes thin, and accordingly has a tendency of causing local flexure in the orifice plate when it is laminated. When the thickness of the orifice plate becomes particularly 10 μm or less, it may become difficult even to handle the orifice plate, and the plate tends to easily cause flexure or deformation.

It is also effective as another method of reducing the power consumption to reduce a gap between an energy-generating element and an ejection orifice (or, orifice plate). However, as the gap between the energy-generating element and the ejection orifice becomes smaller, the variation in the gap distances due to the flexure of the orifice plate produces a relatively large influence on the performance.

Furthermore, as is pointed out in Japanese Patent Application Laid-Open No. H11-334079, when the gap between the energy-generating element and the ejection orifice becomes smaller, there is a possibility that the orifice plate may be locally flexed or bent and may be brought into contact with the energy-generating element. If the orifice plate contacts the energy-generating element, there are cases where foaming to be caused by a heater is disturbed and there are cases where the ink thereby cannot be ejected.

Accordingly, when it is intended to make the orifice plate thinner or decrease the gap between the energy-generating element and the orifice plate, for the purpose of lowering the power consumption, the influence of the flexure of the orifice plate becomes more serious.

The causes of the above described flexure of the orifice plate may include non-uniformity of the pressure applied when the orifice plate is pressure-bonded, low flatness of the flow channel member surface and the orifice plate surface, and deformation of the orifice formed during the manufacturing thereof. The issue of flexure has been conventionally solved by enhancing the uniformity of the pressure applied to the head substrate when the head substrate is pressure-bonded, and flattening the surface to be bonded. In Japanese Patent Application Laid-Open No. 2001-18392, a method is proposed by which a joint-assisting member is provided between an orifice plate and a flow channel member and the joint-assisting member is caused to absorb unevenness on the surface of the flow channel member.

However, there is a limit even when the uniformity of the pressure-bonding pressure and the flatness of a face to be bonded are improved, and it may be difficult to enhance the yield of the head only by the above methods. It may also be difficult to provide such an effect as to suppress the flexure that may locally occur in the orifice plate when the orifice plate is simply pressure-bonded with the flow channel member as in a conventional technology.

In addition, the method of providing a joint-assisting member between the flow channel member and the orifice plate as described in Japanese Patent Application Laid-Open No. 2001-18392 is disadvantageous in terms of the cost by an additional process of using the joint-assisting member.

SUMMARY OF THE INVENTION

The present invention is made in light of the above described issues. An object of the present invention is to provide a droplet ejection head which can surely prevent the flexure of an orifice plate with a simple and easy structure, and which can reduce an influence of the flexure of the orifice plate even when the plate thickness is decreased or when the gap between the energy-generating element and the plate is decreased.

Another object of the present invention is to provide a method for manufacturing the droplet ejection head.

According to an aspect of the present invention, there is provided a method for manufacturing a droplet ejection head having a structure in which a substrate having an energy-generating element that imparts energy to a liquid to eject a liquid droplet from an ejection orifice and an orifice plate having the ejection orifice formed therein are laminated through a flow channel member for forming a pattern of a liquid flow channel that is a region in which the liquid flows, wherein at least one of the orifice plate before being laminated and the flow channel member before being laminated has a void of at least one of a through-hole other than the ejection orifice and a recess in the face to be laminated, the method includes the steps of:

(1) applying a material for forming the flow channel member onto the substrate having the energy-generating element formed therein, and patterning the applied material to form the flow channel member;

(2) stacking the orifice plate on the flow channel member;

(3) heating the flow channel member to the glass transition temperature of the flow channel member or higher;

(4) collectively pressurizing the orifice plate, the flow channel member and the substrate toward the face of the substrate, in a state of the flow channel member kept at the glass transition temperature or higher, thereby compressing the flow channel member, and laminating the orifice plate with the flow channel member; and (5) stopping the pressurization, in this order.

According to another aspect of the present invention, there is provided a droplet ejection head in which a substrate having an energy-generating element that imparts energy to a liquid to eject a droplet from an ejection orifice, and an orifice plate having the ejection orifice formed therein are laminated through a flow channel member for forming a pattern of a liquid flow channel that is a region in which the liquid flows, wherein the orifice plate before being laminated has a void of at least one of a through-hole other than the ejection orifice and a recess in the face to be laminated; compared with a region of the flow channel member in the vicinity of the void, other region of the flow channel member is thicker; and the orifice plate is laminated in such a way as to conform to the surface shape of the flow channel member.

Further features of the present invention will become apparent from the following description of exemplary embodiments with reference to the attached drawings.

BRIEF DESCRIPTION OF THE DRAWINGS

FIG. 4A is a plan view of a circular through-hole, and FIG. 4B is a plan view of a rectangular through-hole.

FIG. 9A is a sectional view of a liquid ejection head having a recess in the orifice plate, and FIG. 9B is a sectional view of a liquid ejection head having a recess in the flow channel member.

DESCRIPTION OF THE EMBODIMENTS

Preferred embodiments of the present invention will now be described in detail in accordance with the accompanying drawings.

As was described above, conventionally when a liquid ejection head is manufactured by laminating a head substrate having a flow channel member formed thereon with an orifice plate through the flow channel member, there has been a possibility that local flexure or lifting occurs in the orifice plate. Accordingly, the present invention aims at providing a structure for preventing the flexure or lifting of the orifice plate, in a droplet ejection head to be manufactured by laminating the orifice plate with the flow channel member, and to a method for manufacturing the same. More specifically, the present invention provides a method for manufacturing a droplet ejection head which can surely prevent the flexure of the orifice plate with a simpler and easier structure than that of a conventional head, when manufacturing the droplet ejection head by laminating the orifice plate with the flow channel member. Furthermore, the present invention provides a method for manufacturing a droplet ejection head which can reduce the influence of the flexure of the orifice plate even when the orifice plate is thinned or the gap between the energy-generating element and the orifice plate is decreased for lowering the power consumption.

According to the present invention, the droplet ejection head can be deformed so that the flow channel member has a step after the orifice plate has been laminated with the flow channel member by pressure bonding, when the droplet ejection head is manufactured by laminating the orifice plate with the flow channel member. Furthermore, the orifice plate can be deformed along the shape of the flow channel member. As a result of this, the orifice plate face in the periphery of the ejection orifice is stretched to the plane direction, and thereby the flexure of the orifice plate can be further reduced.

Furthermore, according to the present invention, the gap between the orifice plate and the energy-generating element can be stably decreased while the flexure of the orifice plate is prevented.

In addition, these effects can be simply realized without newly increasing a manufacturing process and a special structure.

In addition, the droplet ejection head manufactured according to the present invention can be used for a printer, an apparatus for manufacturing a display component, a medical inhaler and the like.

Embodiment 1

Figure 1:
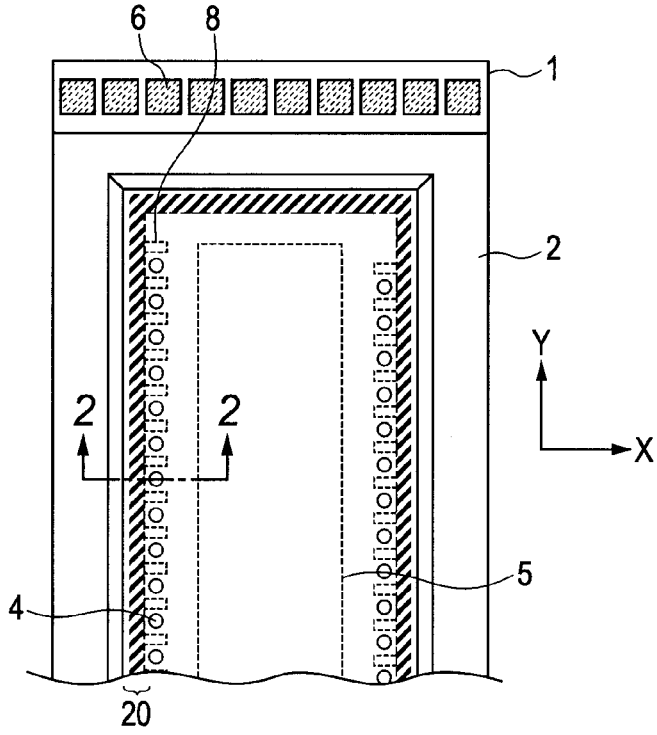
FIG. 1 is a plan view of a droplet ejection head obtained according to Embodiment 1 of a method for manufacturing a droplet ejection head.
Figure 2:
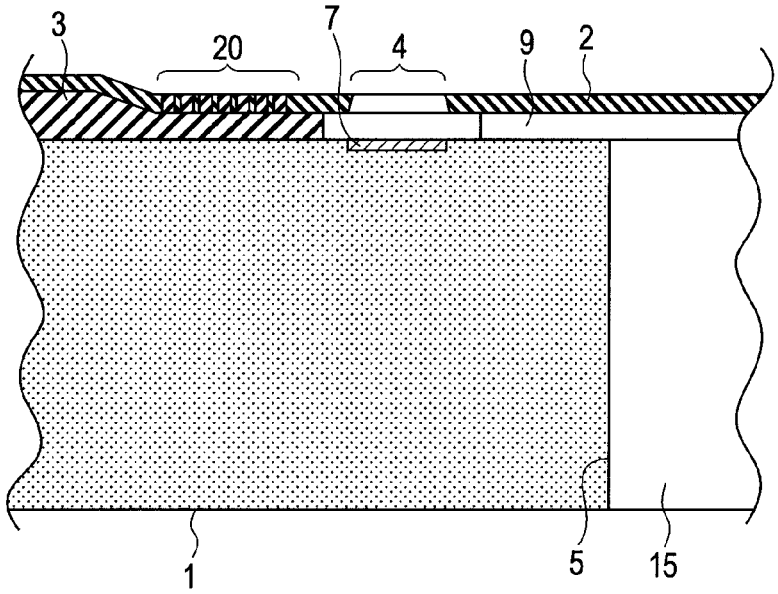
FIG. 2 is a sectional view taken along the line 2-2 shown in the droplet ejection head of FIG. 1.

Embodiments of the manufacturing method according to the present invention will be described below with reference to the drawings. In the description, an ink jet head out of the liquid ejection heads is taken as an example. Firstly, FIG. 1 illustrates a plan view of an ink jet recording head chip manufactured according to Embodiment 1 of the manufacturing method of the present invention. In addition, FIG. 2 illustrates the sectional view taken along the line 2-2 of FIG. 1. In FIG. 1, a dashed line represents a portion which is not seen from the surface. In addition, a shaded portion represents a deformation induction region 20 which will be described later. In this embodiment, an example in which the deformation induction region 20 is formed in one part of the orifice plate will be described.

As is illustrated in FIG. 2, an ink jet recording head obtained according to Embodiment 1 uses a heater 7 as an energy-generating element. The heater 7 is formed on a substrate 1 of silicon, glass or the like. As the heater 7, an electroconductive material such as tantalum nitride is suitable which has a specific resistance higher than a metal by one digit or more. A piezoelectric body may also be used as an energy-generating element other than the heater.

Though being not shown, a transistor, wiring and the like which constitute a circuit such as a shift register can be formed on the surface of the substrate 1, and a protection layer of silicon oxide, silicon nitride or the like against ink can be formed on the heater 7.

Furthermore, a flow channel member 3 is formed on the substrate 1, which flow channel member corresponds to the wall of an ink flow channel 9 that is a region in which the ink flows, and forms a pattern of the ink flow channel. In addition, the ink flow channel 9 which is a liquid flow channel communicates with an ejection orifice 4 for ejecting the liquid. The ejection orifice 4 is a through-hole which penetrates the orifice plate 2. In addition, the flow channel member to be used in the present invention has a glass transition temperature. The orifice plate 2 is laminated onto the flow channel member 3. The ejection orifice 4 is opened in the orifice plate 2 at a site directly above the heater 7. When the heater is energized, the ink is ejected from the ejection orifice 4 by a pressure generated when the ink on the heater 7 is boiled.

An ink supply port 15 is opened in the substrate 1, and the ink supply port 15 communicates with an ink flow channel 9. The ink is supplied from the back face of the substrate through the ink supply port 15. In addition, the outer circumferential part 5 of the ink supply port is shown in the drawings.

In the ink jet recording head which is illustrated in FIG. 2 and is obtained according to Embodiment 1, the flow channel member 3 formed from the same material has a two-stage shape, and the flow channel member in the outer circumferential part of the ink flow channel 9 is lower by one stage. The upper face (face on the orifice plate side) of the flow channel member in the periphery of the ink flow channel 9 forms a flat face, but as the flow channel member 3 comes distant from the ink flow channel 9, the flow channel member 3 is thicker in a sloping state and eventually reaches a one-stage higher flat face.

Because the orifice plate 2 is laminated so as to conform to the surface shape of the flow channel member 3 having the above described two-stage shape, the orifice plate 2 similarly has a two-stage shape, and the distance between the orifice plate 2 and the substrate 1 is smallest in the vicinity of the ejection orifice 4.

FIGS. 3A, 3B, 3C, 3D and 3E illustrate views of a process of manufacturing the droplet ejection head shown in FIG. 1.

Figure 3A:
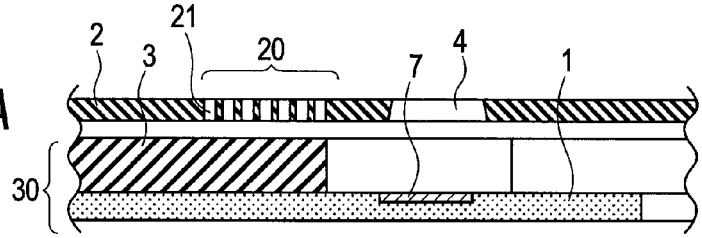
FIGS. 3A, 3B, 3C, 3D and 3E are sectional views for describing the procedures in Embodiment 1 of the method for manufacturing the droplet ejection head.

Firstly, as is illustrated in FIG. 3A, a head substrate 30 and the orifice plate 2 are prepared. The head substrate 30 has the flow channel member 3 on the substrate 1 having the heater 7. Here, an organic resin is suitable as a material of the flow channel member 3. This is because the method for manufacturing the droplet ejection head according to the present invention preferably employ as the flow channel member 3 a material which has small elastic modulus and can be plastically deformed, and the organic material has such characteristics. Furthermore, the organic material preferably has photosensitivity in order to reduce the number of manufacturing steps and particularly preferably may be a permanent resist having photosensitivity.

Specifically, the organic material preferably may be a photosensitive, negative type of permanent resist which is made of an epoxy resin or a polyimide resin as its material. Specific commercial resists include TMMR (trade name, made by TOKYO OHKA KOGYO CO., LTD.), SU8 (trade name, made by Kayaku MicroChem Corporation) and EHPE-3150 (trade name, made by Daicel Chemical Industries, Ltd.). A suitable thickness of the flow channel member 3 is 1 μm or more and 100 μm or less.

The flow channel member 3 is fabricated, for instance, by using a permanent resist in the following way. The permanent resist having photosensitivity is applied onto the substrate 1 by a spin coating method or a laminating method. The permanent resist film is patterned by exposing the applied permanent resist to light and developing the resultant permanent resist. Then, the permanent resist film is cured by heat-treating the substrate 1 in an oven or on a hot plate or the like. Thereby, adequate elastic modulus is developed, and the flow channel member 3 is formed (step 1). As for heat treatment conditions at this time, a permanent resist film does not need to be completely cured, and the period of time and the temperature can be optimized according to a desired elastic modulus.

When the organic resin to be applied does not have photosensitivity, the organic resin is optionally applied onto the substrate by the spin coating method or the laminating method, a resist having photosensitivity is applied onto the applied organic resin, the applied resist is exposed to light and the resultant resist is developed. Then, the organic resin is etched while using the resist pattern as a mask, and thus the flow channel member 3 may also be optionally formed. A thin layer (approximately 1 to 3 μm) of polyether amide, for instance, can be provided between the flow channel member 3 and the substrate 1, in order to enhance the bonding property of both members.

An ejection orifice 4 is formed in the orifice plate 2. Furthermore, in the orifice plate 2 before being laminated, a deformation induction region 20 is provided separately from the ejection orifice 4, in the vicinity of the outer circumferential part of the ink flow channel which is a liquid flow channel of the face to be laminated, in other words, in the vicinity of the outer circumferential part 8 of the flow channel member and also on a side nearer to the flow channel member than the outer circumferential part of the ink flow channel.

The outer circumferential part of the ink flow channel (outer circumferential part of liquid flow channel) means the boundary between the flow channel member 3 and the ink flow channel 9 (liquid flow channel).

A portion of the orifice plate 2 in the vicinity of the outer circumferential part of the liquid flow channel on the face to be laminated and nearer to the flow channel member side than the outer circumferential part of the liquid flow channel means a region of the orifice plate which is located on the flow channel member when having been laminated and is near to the outer circumferential part of the ink flow channel.

The deformation induction region 20 in FIGS. 3A to 3E means one part of the orifice plate which includes a void (empty space) of at least one of a through-hole and a recess (hole having a bottom) separately from the ejection orifice in the region, which will be described later. This deformation induction region 20 contains the through-hole or the recess, and accordingly has such characteristics that the orifice plate 2 has a spatially sparser density than the other sites.

When the void is formed in the orifice plate 2, the void can be formed in a position corresponding to a region nearer to the flow channel member side, for instance, by 5 to 500 μm from the outer circumferential part of the ink flow channel, as a portion in the vicinity of the outer circumferential part of the liquid flow channel and nearer to the flow channel member side than the outer circumferential part of the liquid flow channel.

According to Embodiment 1 illustrated in FIGS. 1 and 2, the deformation induction region 20 contains a large number of through-holes 21. As is illustrated in FIG. 1, the deformation induction region 20 is formed with some width in the vicinity of the outer circumferential part of the ink flow channel 9.

Figure 4A:
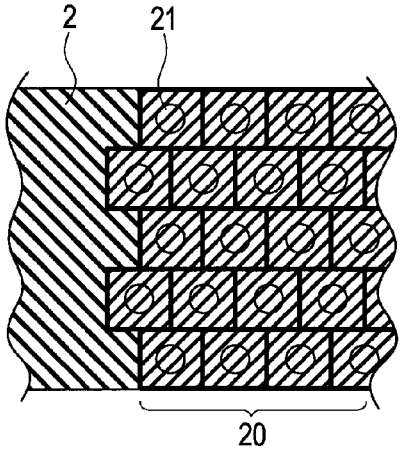
FIGS. 4A and 4B are plan views illustrating examples of a pattern of a through-hole formed in the orifice plate.
Figure 4B:
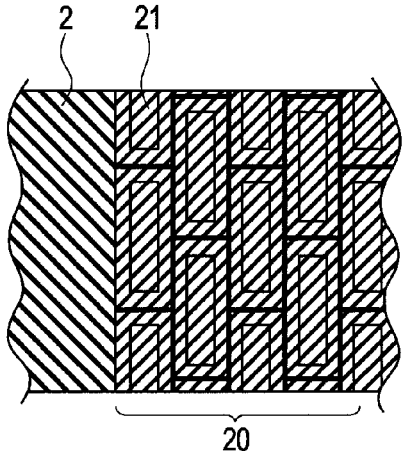

FIGS. 4A and 4B illustrate examples of plan views of the deformation induction region 20 formed in the orifice plate 2. FIG. 4A is an example of the deformation induction region 20 containing circular through-holes 21. The through-holes 21 are each arranged on the vertexes of equilateral triangle. This configuration has such an advantage that the through-holes 21 can be uniformly arranged at high density in the deformation induction region 20. The shape of the through-hole 21 contained in the deformation induction region 20 is not limited to the circle, but may also be a rectangle as in FIG. 4B.

Typically, a large number of voids having the same shape are arranged at an equal space on the face to be laminated of at least one of the orifice plate and the flow channel member. As is illustrated in FIGS. 4A and 4B, in cases where the above described voids are formed in the orifice plate, the deformation induction region 20 can be defined in the following way.

The rectangle defined by the following description is considered on the face to be laminated of the orifice plate having voids (through-holes 21 in FIGS. 4A and 4B) formed therein.

Firstly, middle points are taken between each center of all voids and centers of other adjacent voids. Subsequently, each rectangle is defined so that the center of the each rectangle matches with each center of the above described all voids, and that the each rectangle has sides passing through the above described middle points and corresponds to each void.

At this time, as is illustrated in FIGS. 4A and 4B, the each void is contained in a region of the corresponding rectangle, in the above described face to be laminated. The respective sides of the rectangle are made parallel to a long side direction (Y-direction) or a short side direction (X-direction) of a head chip illustrated in FIG. 1.

When a void (void A) having only one adjacent void (void B) exists, a rectangle corresponding to the void A can be defined in the following way. Firstly, the middle point M between the center $C_A$ of the void A and the center $C_B$ of the void B is taken on the face to be laminated of the orifice plate. Then, the rectangle is defined so that the distance between the respective four sides constituting the rectangle and the edge of the void A matches with the distance between the middle point M and the edge of the void A. At this time, the respective sides of the rectangle are made parallel to the above described X-direction or Y-direction. When the shape of the void A on this face is a circle, the above described rectangle is a square.

When the orifice plate 2 is subsequently laminated with the flow channel member 3, the portion of the orifice plate 2 which is demarcated by the region R that overlaps with the flow channel member 3, out of the regions in which the above described all rectangle regions are connected, can be defined as the deformation induction region 20. In other words, the deformation induction region 20 can be defined as a rectangular cylinder which has the above described region R as its bottom face and the thickness of the orifice plate as its height.

Regions shown by thick lines in FIGS. 4A and 4B are the above described rectangle regions which define each through-hole 21 as the center, and the portion of the orifice plate 2 demarcated by the region shown by the diagonal line which connects these rectangular regions is the deformation induction region 20. The above described all rectangle regions in FIGS. 4A and 4B overlap with all the flow channel members when the orifice plate 2 is laminated.

The material constituting the orifice plate 2 may preferably be a material having high heat resistance, and more preferably may be an inorganic material of which the elastic modulus is not greatly lowered by the action of heat. Examples of the orifice plate can include: a nickel thin film, a platinum thin film, a gold thin film and a palladium thin film which have been produced by an electrocasting method; a silicon thin film and a silicon oxide thin film which have been formed by a sputtering method, a chemical vapor deposition method or the like; and an iron thin sheet, a tantalum thin sheet, a tungsten thin sheet and a stainless steel thin sheet which have been produced by a stamping process. When the organic resin is used as the material of the orifice plate, the organic resin can be a material having a high glass transition temperature such as polyimide. The thickness of the orifice plate 2 may be 1 μm or more and 50 μm or less.

When the orifice plate 2 and the head substrate 30 are laminated through the flow channel member 3, any one of the flow channel member 3 and the orifice plate 2 may preferably have adhesiveness. When both of them have low adhesiveness, an adhesive may also be transferred onto the face to be laminated of the flow channel member 3 or the orifice plate 2, though being not shown in FIG. 3A.

Figure 3B:
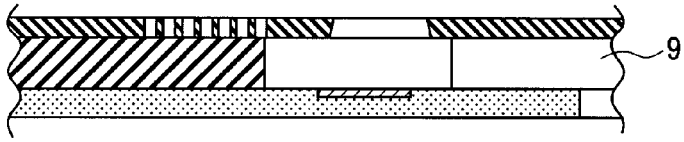

As is illustrated in FIG. 3B, the orifice plate 2 is stacked on the flow channel member 3 (step 2), both of them are aligned, and the orifice plate 2 and the flow channel member 3 are pressure-bonded at such a low temperature and a low pressure that both are not strongly stuck to each other, and are temporarily fixed accordingly. Specific temperature and pressure can be determined depending on the material of the flow channel member, as needed. At this time, the deformation induction region 20 in the orifice plate is arranged on the flow channel member.

Figure 3C:
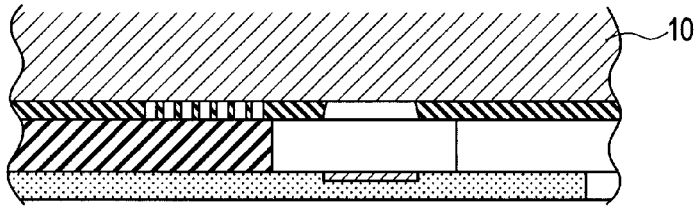

After having been temporarily fixed, as is illustrated in FIG. 3C, a fixing member 10 is placed on the orifice plate 2. The fixing member 10 is used for fixing the surface (face on the side of ejection direction) of the orifice plate 2 during pressure bonding. When the temporary fixation is not needed, the step of FIG. 3B is unnecessary.

The fixing member 10 is desirably firm, and may preferably have at least an elastic modulus higher than that of the orifice plate 2 or the flow channel member 3. This is because the flow channel member 3 is preferably compressed and deformed by a high pressure having been applied thereto, in the manufacturing method according to the present invention, and when the fixing member 10 as well is compressed upon pressure bonding, there is a possibility that the fixing member can not fix the orifice plate while keeping the flatness of the surface of the orifice plate.

In addition, from the same reason, the surface of the fixing member 10 is preferably smooth, and is desirably smoother than the surface of the orifice plate. From the above description, a bulk substrate with a polished surface may preferably be used as a material suitable for the fixing member 10. Specific examples of the fixing member 10 include a single-crystal silicon substrate, a glass substrate and a stainless steel substrate. In addition, the fixing member 10 may previously be bonded with the orifice plate 2, and the fixing member 10 and the orifice plate 2 may temporarily be fixed onto a head substrate 30 together.

Figure 3D:
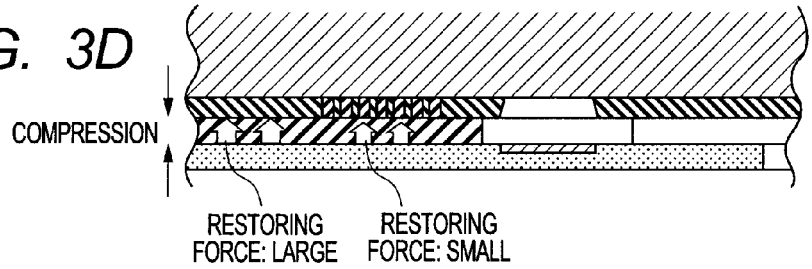
Figure 5:
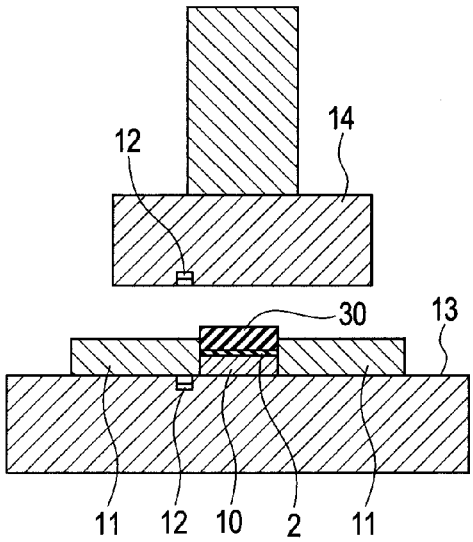
FIG. 5 is a sectional view of a thermocompression bonding machine which can be used in the manufacture of the droplet ejection head.

After having been temporarily fixed, a sample (stacked, fixing member 10, orifice plate 2, flow channel member 3 and substrate 1) is completely pressure-bonded by using a thermocompression bonding machine as illustrated in FIG. 5. FIG. 5 is a view in which a sample pressure-bonding portion has been enlarged. After a sample stage 13 has been heated to a pressure bonding temperature, the sample is placed on the sample stage 13 so that a fixing member 10 side of the sample faces to a sample stage 13 side of the thermocompression bonding machine, and is fixed with a sample fixing jig 11, and the flow channel member is heated to the glass transition temperature thereof or higher (step 3). At this time, the flow channel member is preferably heated to a temperature (° C.) of 1.25 times or more the glass transition temperature (° C.). Then, a pressure-bonding rod 14 of the thermocompression bonding machine is approached to the head substrate 30 from the side of the back face of the head substrate in such a state that the temperature of the flow channel member is kept at the glass transition temperature or higher, and the pressure bonding is started. As a result of this, the sample is collectively pressurized from the back face of the head substrate 30 in a direction perpendicular to the substrate face, and the orifice plate and the flow channel member are laminated (FIG. 3D, step 4). One face of the head substrate provided with a head structure such as a flow channel member is referred to as a surface, and the other face is referred to as a back face.

A pressure-bonding pressure to be applied at this time may preferably be such a level or more as to compress and distort the flow channel member 3. More specifically, when an epoxy resin is used as the flow channel member, the elastic modulus of this resin which has been heated to the glass transition point or higher is approximately 10 MPa or less, and accordingly when the pressure-bonding pressure is 0.1 MPa or more, preferably the resin can be distorted with a large displacement, such as 1% or more with respect to the initial resin thickness.

The pressure-bonding pressure means a pressure of pressurizing the sample upon thermocompression bonding. In addition, the pressure bonding temperature may preferably be the glass transition temperature or higher of the flow channel member 3. Thereby, the elastic modulus of the flow channel member 3 can be considerably decreased, and as a result of this, the flow channel member 3 can be easily compressed by the pressure from the thermocompression bonding machine. When the pressure-bonding pressure is sufficiently high (when the pressure-bonding pressure is preferably as high as nearly the yield point) at the pressure bonding temperature, the flow channel member 3 starts causing plastic deformation while being compressed. In such a situation, the flow channel member 3 in the vicinity of the deformation induction region 20 expands toward the through-hole 21 in the deformation induction region 20 and the ink flow channel 9 of the orifice plate 2, while being plastically deformed. The flow channel member 3 infiltrates into the through-hole 21 of the deformation induction region 20. At this time, the flow channel member may infill the whole through-hole, or may also infill a part of the through-hole.

The pressure bonding temperature means a temperature of a sample which is heated upon thermocompression bonding. The pressure bonding period of time may preferably be a period of time during which such a plastic deformation of the flow channel member 3 easily progresses and is preferably 5 sec or longer and 90 min or shorter. The pressure bonding period of time means a period of time during which the sample is pressurized upon thermocompression bonding.

A compressive stress is applied onto the flow channel member 3 from a direction at right angles to the face (from the direction perpendicular to the substrate face), and the flow channel member 3 is distorted. In the flow channel member 3 in the vicinity of the deformation induction region 20, the plastic deformation has occurred as described above, and accordingly the compressive stress is alleviated. As a result of this, the distribution of the compressive stress occurs in the flow channel member 3. Specifically, the compressive stress is low in the vicinity of the deformation induction region 20 of the flow channel member 3, and the compressive stress is high in other portions. In the boundary parts between them, the magnitude of the stress smoothly changes as the place changes. In the step of FIG. 3D, the orifice plate 2 and the flow channel member 3 are laminated at the same time when the flow channel member 3 is compressed.

Subsequently, when the pressure-bonding rod 14 illustrated in FIG. 5 is separated from the sample in order to stop pressurization, a restoring force proportional to the compressive stress acts, so that the strain dissipates, and the thickness of the flow channel member 3 tends to return to the initial thickness (step 5). However, the flow channel member which is located near to the void (vicinity of void), more specifically, in the vicinity of the deformation induction region 20, has a smaller compressive stress and also a smaller restoring force compared to those in other sites, and accordingly after the pressurization has been stopped, the thickness of the flow channel member which has been bonded to the deformation induction region is thinner than that in the other sites.

For instance, compared to the thickness of the flow channel member which is bonded to the deformation induction region and to the region in the vicinity of approximately 100 μm or inner than the deformation induction region in the orifice plate, the thickness of the flow channel member in other regions can be thickened.

Figure 3E:
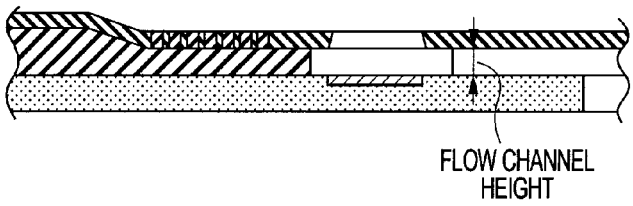

As a result of this, the flow channel member 3 is deformed so as to have a smooth step, and the ink jet recording head illustrated in FIG. 3E is thus completed.

The temperature at the time when the pressurization has been stopped (step 5) may preferably be the same temperature as in the pressurization from the viewpoint of the restoring force, but can be appropriately set as long as the effect of the present invention can be obtained.

Figure 6:
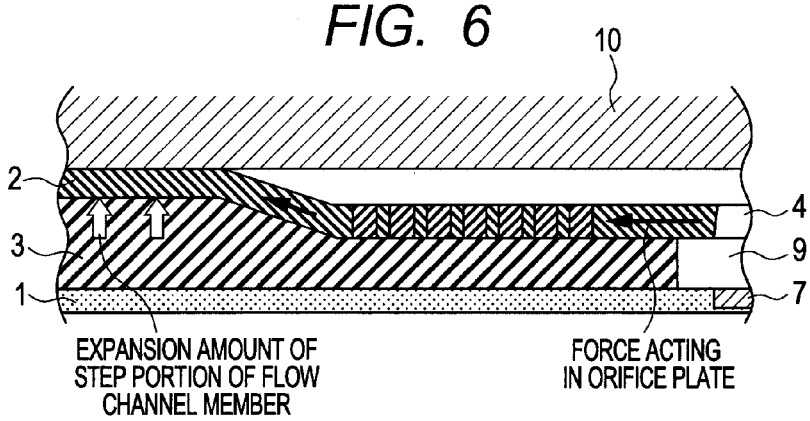
FIG. 6 is a view illustrating a force generated in the orifice plate in Embodiment 1 of the method for manufacturing the droplet ejection head.

In addition, along with the deformation of the flow channel member 3, the orifice plate 2 which adheres onto the flow channel member is also deformed so as to conform to the surface shape of the flow channel member 3. Specifically, the orifice plate region is downwardly recessed in the vicinity of the deformation induction region 20 and the ink flow channel 9. Along with the deformation of this orifice plate 2, a force as illustrated in FIG. 6 is generated in the orifice plate, the orifice plate on the ink flow channel 9 is stretched to the direction of the force, and accordingly the flexure is resolved. The flexure in the vicinity of the ejection orifice 4 is more effectively resolved, because the orifice plate 2 there is stretched to all directions of the outer circumference of the ink flow channel 9. The orifice plate 2 and the flow channel member 3 may preferably be deformed in such a state that a certain degree of pressure is applied thereto by the pressure-bonding rod 14. Thereby, the uniformity of the pressure in the flow channel member is easily kept, and as a result of this, the flatness of a step flat portion is also easily kept.

In the manufacturing method according to the present invention, the flow channel member is heated to the glass transition temperature or higher, and is pressure-bonded while the flow channel member is kept at a temperature of the glass transition temperature or higher. The material of the orifice plate 2 may preferably be an inorganic material. If the material is the inorganic material, when the orifice plate is pressure-bonded at a temperature of the glass transition temperature or higher, the orifice plate 2 can easily keep adequate rigidity and can easily prevent flexure. This is because almost all of the inorganic materials hardly change the elastic modulus even if having been heated to a temperature around the glass transition temperature of the organic resin. Furthermore, the orifice plate 2 may preferably be a metal. This is because a metal is superior in ductility and more resists the occurrence of brittle fracture even when the orifice plate 2 is plastically deformed in two stages. When considering particularly the stability with respect to the ink and the brittle fracture resistance of the material, at least one metal or alloy is preferred which is selected from the group consisting of nickel, palladium, gold, platinum, iron, tantalum, tungsten and stainless steel, out of the inorganic materials.

The pressure bonding temperature used in the manufacturing method according to the present invention may preferably be the glass transition temperature or higher of the flow channel member 3, more preferably a temperature (° C.) of 1.25 or more times the glass transition temperature (° C.) of the flow channel member 3. The reason is described in the following way.

In order to easily produce an appropriate step by pressurizing the flow channel member 3, the flow channel member 3 may preferably be distorted to a large extent. As is described in Examples which will be described later, in case of almost all of organic resins, when are heated to a temperature (° C.) of 1.25 or more times the glass transition temperature (° C.) of the flow channel member 3, the elastic modulus decreases to approximately $10^{-3}$ times of the value of elastic modulus measured at room temperature. Accordingly, the flow channel member 3 is easily softened.

For instance, when the compressive elasticity modulus of the organic resin at room temperature is supposed to be 10 GPa, the heating of the organic resin to a temperature (° C.) of 1.25 or more times the glass transition temperature (° C.) decreases the elastic modulus down to 10 MPa. At this time, when a pressure which can be given by a usual pressure-bonding machine (approximately 1 MPa or less) is applied onto the organic resin, the compression strain (ratio obtained by dividing thickness variation caused by compression by initial thickness) of the organic resin becomes 10%. In a largely distorted region the compression strain of which is 10% or more (in other words, in the vicinity of the yield point), the organic resin can easily undergo plastic deformation. As a result of this, an appropriate distribution of compressive stress can easily be created in the flow channel member 3 according to the above described mechanism, and an adequate step can be easily formed on the flow channel member 3 and the orifice plate 2.

For instance, when an epoxy resin (glass transition temperature: approximately 180° C.) is used for the flow channel member 3, the flow channel member may preferably be pressure-bonded at a temperature of 225° C. or higher. When a polyimide resin (glass transition temperature: approximately 250° C.) is used for the flow channel member 3, the flow channel member may preferably be pressure-bonded at a temperature of 313° C. or higher.

In addition, the temperature used upon the pressure bonding may preferably be lower than the flowing point of the flow channel member 3. When the heating temperature is lower than the flowing point, the flow channel member 3 can be easily prevented from being remarkably liquefied, and the flow channel member 3 can be easily prevented from widely flowing and spreading to sites of the energy generating element, a contact pad 6 and the like. Accordingly, the pressure bonding temperature may preferably be the glass transition temperature or higher of the flow channel member 3 and lower than the flowing point of the flow channel member 3.

Figure 8A:
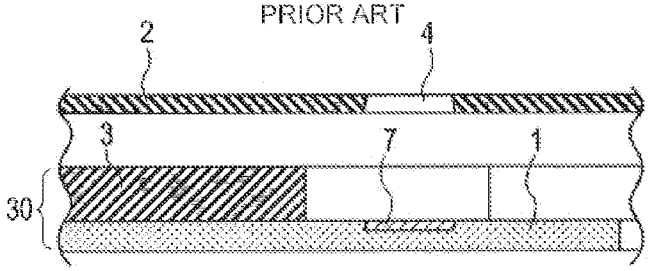
FIG. 8A PRIOR ART
FIGS. 8A and 8B are sectional views for describing a conventional process of manufacturing a droplet ejection head.
Figure 8B:
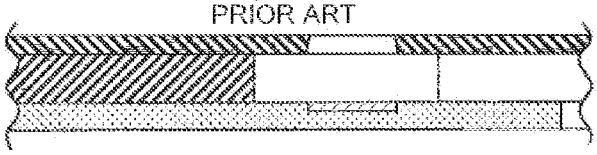
FIG. 8B PRIOR ART

Both of the conventional manufacturing method as illustrated in FIGS. 8A and 8B and the manufacturing method according to the present invention as illustrated in FIGS. 3A to 3E need only one time of the thermocompression bonding step carried out and require the same number of constituent members for a droplet ejection head. Accordingly, the manufacturing method according to the present invention can achieve a throughput equivalent to that of the conventional manufacturing method and also can make the cost equivalent to that of the conventional manufacturing method, by optimizing the manufacturing conditions.

In the structure of the droplet ejection head obtained according to Embodiment 1 illustrated in FIG. 1 and FIG. 2, a two-stage step structure is formed in the orifice plate 2. Such a step structure has such an advantage as not to damage the ejection orifice 4 when the head surface is wiped. In the present invention, such a step structure can be achieved in fewer steps than the conventional manufacturing method. For instance, in Japanese Patent Application Laid-Open No. H11-334079, the flow channel member needs to be patterned at least twice in order to form the two-stage flow channel member. In contrast to this, in the manufacturing method according to the present invention, the flow channel member 3 needs only one time of patterning.

Conventionally, the orifice plate having such a step structure has had such a tendency that the recess in the flow channel member 3 can hardly be sufficiently pressurized at the time of the pressure-bonding of the orifice plate, and there have been cases where the adhesiveness between the orifice plate and the flow channel member 3 at the recess is low. For that reason, there have been cases where local flexure easily occurs, such as a case where the lowest face (face on the side of the flow channel member) of the orifice plate results in partial lifting higher than the height of the upper face (face on the side of the plate) of the flow channel member 3. On the other hand, in case of the head manufactured according to the present invention, a sufficient pressure can be applied to the whole face of the orifice plate 2 upon pressure bonding, and the flow channel member 3 can infill the through-hole 21 of the deformation induction region 20 and can be hardened. Thereby, the adhesiveness between the orifice plate 2 and the flow channel member 3 in the outer circumferential part of the ink flow channel is further enhanced, the orifice plate 2 is strongly fixed, and the occurrence of local flexure can be suppressed.

In addition, in a conventional technology, unless the orifice plate 2 is softened, it is very difficult to laminate the orifice plate 2 according to the shape of the flow channel member 3 having such a step. In contrast to this, in the present invention, a step is formed in the flow channel member 3 and the orifice plate 2 after the orifice plate 2 and the flow channel member 3 have been laminated together in such a state that the flow channel member 3 has no step. Accordingly, even though the orifice plate is made of a material like a metal which does not become softened, the orifice plate 2 can be finely laminated to the flow channel member 3 having the step according to the surface of the latter.

Embodiment 2

Figure 7A:
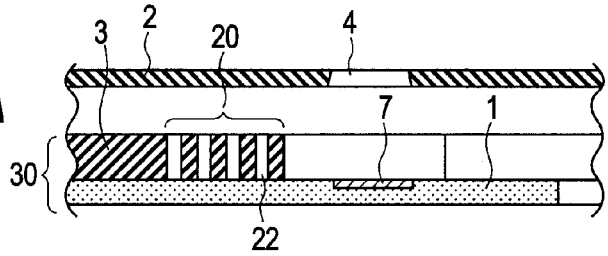
FIGS. 7A, 7B, 7C, 7D and 7E are sectional views for describing the procedures in Embodiment 2 of the method for manufacturing the droplet ejection head.

As Embodiment 2 of the manufacturing method according to the present invention, an example will be described below in which the deformation induction region 20 is provided in the flow channel member 3 side. FIGS. 7A, 7B, 7C, 7D and 7E illustrate a process of manufacturing a droplet ejection head of Embodiment 2. In FIG. 7A, through-holes, in other words, grooves 22 are provided in a portion in the vicinity of the outer circumferential part of an ink flow channel 9 on the face to be laminated of a flow channel member 3 on a chip substrate, in other words, in a portion in the vicinity of the outer circumferential part 8 of the flow channel member and nearer to a flow channel member side than the outer circumferential part of the ink flow channel, and the deformation induction region 20 includes the grooves 22.

The portion in the vicinity of the outer circumferential part of the liquid flow channel on the face to be laminated of the flow channel member 3 and nearer to the flow channel member side than the outer circumferential part of the liquid flow channel means a region of the flow channel member 3 which is closer to the outer circumferential part of the ink flow channel when the flow channel member has been laminated.

When a void is formed in the flow channel member 3, the void can be formed in a position corresponding to a region nearer to the flow channel member side, for instance, by 5 to 500 μm from the outer circumferential part of the ink flow channel, as the portion in the vicinity of the outer circumferential part of the liquid flow channel and nearer to the flow channel member side than the outer circumferential part of the liquid flow channel.

In the case in which the void has been formed in the flow channel member 3 side, the deformation induction region 20 can be defined in the following way similarly to that in Embodiment 1. Firstly, on the face to be laminated of the flow channel member in which the void (groove 22 in FIGS. 7A to 7E) has been formed, a rectangle corresponding to each void is defined in a similar way to that in Embodiment 1.

Then, in the flow channel member 3, a portion demarcated by the region in which the above described all rectangle regions have been connected each other can be defined as the deformation induction region 20.

In the present embodiment, the groove 22 is a groove which has been discontinuously formed in the flow channel member 3, as in FIG. 4B. In the orifice plate 2, only an ejection orifice 4 is provided, and the material of the orifice plate is the same as in Embodiment 1. The plan view of the droplet ejection head manufactured in Embodiment 2 is equivalent to that in FIG. 1.

Figure 7B:
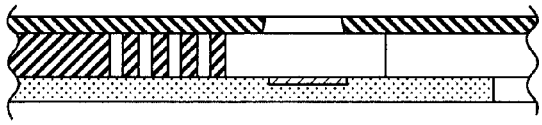
Figure 7C:
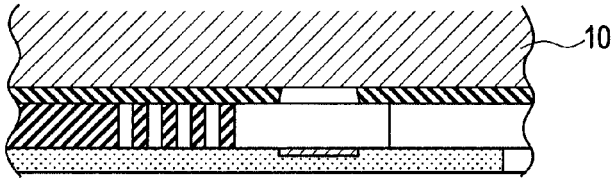
Figure 7D:
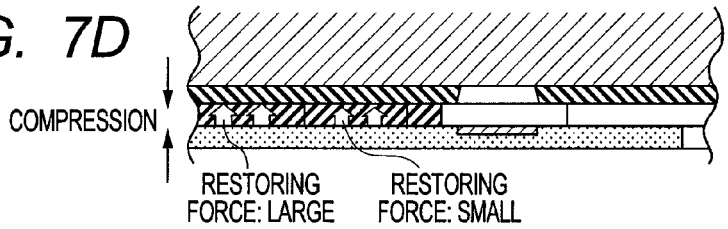

In FIG. 7B, the orifice plate 2 is aligned with a head substrate 30 and is temporarily fixed by thermocompression bonding in a similar way to that in Embodiment 1. After that, a fixing member 10 is provided on the orifice plate 2. A sample (stacked, fixing member 10, orifice plate 2, flow channel member 3, and substrate 1) is set on a sample stage 13 of a pressure-bonding machine (FIG. 7C). This sample is heated to the glass transition temperature or higher of the flow channel member 3. Subsequently, the pressure-bonding rod 14 is abutted on the back face of the head substrate 30, and the pressure bonding is started.

Figure 7E:
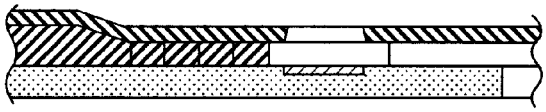

At this time, when the pressure-bonding of the flow channel member is carried out under such a pressure as to sufficiently distort the flow channel member (at such a level that compression strain can be 10% or more) and distort it up to the vicinity of the yield point, with respect to the elastic modulus of the flow channel member 3, the flow channel member in the vicinity of the groove undergoes plastic deformation while being compressed and expands in a plane surface direction so as to plug the groove 22. Since the flow channel member in the vicinity of the groove 22 undergoes the plastic deformation, the compressive stress is alleviated accordingly. As a result, the compressive stress of the flow channel member in the vicinity of the groove 22 is lowered compared to those in other sites, and the distribution of the compressive stresses is formed in the flow channel member 3. When the pressure-bonding rod 14 is separated from the sample in this state and the pressure bonding is stopped, a restoring force in a site having a lower compressive stress in the flow channel member 3 is smaller than those at the other sites, and accordingly such a step is formed that the height at the site becomes lower than those at the other sites. The vicinity of the ink flow channel 9 of the orifice plate 2 is deformed so as to be recessed according to the step of the flow channel member 3, and accordingly the flexure of the orifice plate 2 is resolved. Finally, a droplet ejection head as illustrated in FIG. 7E is completed.

Figure 9A:
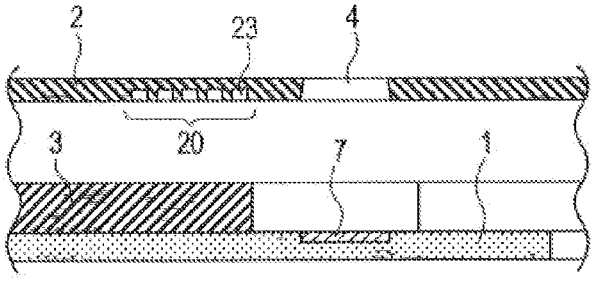
FIGS. 9A and 9B are sectional views illustrating other examples of a liquid ejection head than those in Embodiments 1 and 2.
Figure 9B:
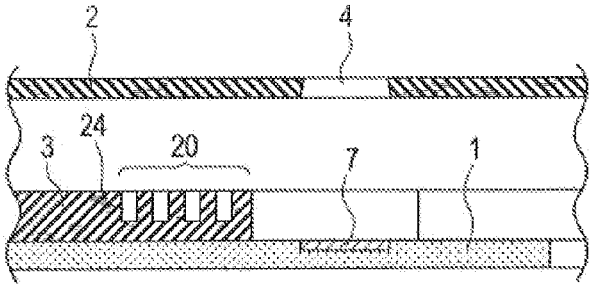

In the above described embodiments, the deformation induction region 20 provided in the orifice plate 2 or in the flow channel member 3 has included a space which penetrates the flow channel member 3, in other words, a through-hole 21 or a groove 22. However, as is illustrated in FIGS. 9A and 9B, the deformation induction region 20 may also include a recess which does not penetrate the member, in other words, at least one of a recess 23 in the orifice plate and a recess 24 in the flow channel member. Furthermore, the deformation induction region 20 may also include both of the through-hole and the recess.

In the manufacturing method according to the present invention, the spatial distribution of the compressive stress can be easily controlled according to the size and position of the deformation induction region 20 provided in at least one of the orifice plate 2 and the flow channel member 3, and the volume in a sparse portion (inner part of the through-hole and inner part of the recess) of the deformation induction region. The size of the step to be finally produced in the flow channel member 3 and the orifice plate 2 and the size of the region to be recessed can also be easily controlled. As the volume in the sparse site is larger, a higher step can be formed.

As has been illustrated in Embodiment 1 or Embodiment 2, when the deformation induction region 20 includes a void in at least one of the orifice plate 2 and the flow channel member 3, the volume of the void necessary for forming a step in the orifice plate will be described below.

The ratio (void content) of the total volume of the sparse portion (inner part of through-hole and recess (inner part of void)) in the deformation induction region to the total volume of the deformation induction region shall be represented by "n". As the "n" is larger, the flow channel member in the deformation induction region infills a greater number of voids, which accordingly results in easily undergoing plastic deformation. As a result, the compressive stress is alleviated, and the difference in the restoring force between the deformation induction region and other regions increases, and further a higher step is produced.

For instance, in the experiments (Examples) by the present inventor, which will be described later, the deformation induction region is formed of an aggregation of circular through-holes as illustrated in FIG. 4A. At this time, the through-holes have a diameter of 5 μm and are arranged at the positions of vertexes of an equilateral triangle with one side of 15 μm, respectively. At this time, n is 0.087, and is 8.7% if expressed in terms of percentage.

According to the experiments by the present inventor, such an effect that the orifice plate is easily deformed and the flexure is easily removed is confirmed under the condition that the n is 0.087. Accordingly, when n is 0.087 or more, or 8.7% or more in terms of percentage, it can be expected that such an effect can be easily obtained and a step is easily produced.

The height of the step can be controlled also by managing the temperature, the pressure and the period of time for thermocompression bonding. As the temperature upon pressure bonding is higher and also the pressure is higher, a higher step is produced. In addition, as the period of time of pressure bonding is longer, the plastic deformation of the flow channel member 3 is more accelerated, and accordingly a higher step is produced.

In Embodiment 1 and Embodiment 2, an ejection orifice 4 is formed in the orifice plate 2 which is still to be laminated. However, the ejection orifice 4 may not be formed before the orifice plate is laminated, but may also be formed after the orifice plate is laminated. In the case, the ejection orifice 4 may be formed in the orifice plate by photolithography and etching after the step of FIG. 3E or FIG. 7E, or the ejection orifice 4 may also be formed therein by laser processing.

When the present invention is carried out, two or more of the above described Embodiments may also be combined. In addition, an example of the ink jet recording head has been described, but the present invention can be applied to a droplet ejection head which can similarly eject a liquid, and can also be applied to a droplet ejection head which is used in other technical fields. The liquid to be ejected includes ink, a protein solution such as a liquid medicine, purified water, and a solution for a wiring material such as silver and solder.

EXAMPLE

Example 1

A wiring of aluminum, an interlayer insulation film of a silicon oxide thin film, a heater thin-film pattern of tantalum nitride, and a contact pad 6 for electrically connecting the wire with an external control section were formed on a 6-inch silicon substrate by a photolithographic process. A liquid epoxy resin solution having a negative-type photosensitivity, which is a material for forming a flow channel member, was applied onto the silicon substrate which had the above components formed thereon, by a spin coating method, and the exposure and development were carried out. The thickness of the applied epoxy resin film (flow channel member 3) was 5.5 μm. The specific composition of the epoxy resin solution will be shown below.

Composition:

- EHPE-3150 (trade name, made by Daicel Chemical Industries, Ltd.) 100 parts by mass
- HFAB (trade name, made by Central Glass Co., Ltd.) 20 parts by mass
- A-187 (trade name, made by Nippon Unicar Company Limited) 5 parts by mass
- SP170 (trade name, made by Asahi Denka Co., Ltd.) 2 parts by mass
- Xylene 80 parts by mass The flow channel member 3 was formed by patterning the epoxy resin film and heat-treating the patterned film at 200° C. By this heat treatment, the epoxy resin film was heat-cured, developed high elastic modulus, and at the same time, enhanced its adhesiveness to the substrate. It is known from a technical literature that a general glass transition temperature for the epoxy resin which is the material of this flow channel member is 180° C. Accordingly, it is assumed that the glass transition temperature of this flow channel member is 180° C.

After the flow channel member 3 was formed on the above described silicon substrate, a protection film for protecting the flow channel member 3 was applied onto the surface of the substrate, and a resist film for an ink supply port 15 was formed on the back face of the silicon substrate. After that, the ink supply port 15 which penetrated the substrate from the back face to the surface was formed by wet-etching the substrate with an etchant formed of an aqueous solution of tetramethylammonium hydroxide which was an alkaline etching solution while warming the etchant. The protection film on the surface of the substrate was then removed with a cleaning liquid, and the wafer was diced and cut out into chips for each head.

An orifice plate 2 was produced by electroforming. More specifically, an ejection orifice 4 and a resist film corresponding to a through-hole 21 for a deformation induction region 20 were formed in the substrate, and a nickel thin film was grown by plating on the substrate with a plating apparatus. After that, the resist film was removed, and the nickel thin film was peeled from the substrate. The nickel thin film was then cut into a size of the orifice plate 2, and the orifice plate 2 was thus produced. The thickness of the orifice plate 2 was 3 μm.

The through-hole 21 in the deformation induction region 20 of the orifice plate 2 was produced into a shape illustrated in FIG. 4A. Specifically, a large number of through-hole patterns were produced in which the planar shape of each through-hole was a circle and the through-holes were arranged on the vertexes of the equilateral triangle, respectively. At this time, the length of one side of the equilateral triangle formed by connecting the through-holes was 15 μm, and the diameters of through-hole 21 were all 5 μm. A void ratio n in the deformation induction region 20 was 0.087, and the deformation induction region 20 was formed from the outermost circumference of the ink flow channel 9 to a perimeter 200 μm closer to a flow channel member side. The shape of the orifice plate 2 was almost the same as that in FIG. 1.

As a fixing member 10, a silicon substrate (having been mirror-polished) was prepared, which had been cut out into the same shape as the chip. A sample stage 13 and a pressure-bonding rod 14 of a thermocompression bonding machine had a heater and a thermocouple 12 provided in the inner parts, and the temperatures of the sample stage 13 and the pressure-bonding rod 14 were previously kept at a pressure bonding temperature.

A head substrate 30 having the flow channel member 3 formed thereon and the orifice plate 2 were prepared, which had been produced as in FIG. 3A. Subsequently, on the sample stage 13, the fixing member 10, the orifice plate 2 and the head substrate 30 were stacked in this order, as illustrated in FIG. 3C. At this time, on the thermocompression bonding machine, these members were stacked while the relative positions thereof were aligned by an alignment mechanism of the thermocompression bonding machine. The sample (fixing member 10, orifice plate 2 and head substrate 30) and the thermocompression bonding machine was positioned as illustrated in FIG. 5.

After that, the sample was pressurized from the back face of the head substrate 30 with the pressure-bonding rod 14, as illustrated in FIG. 3D. The pressure-bonding pressure was 0.2 MPa, the pressure bonding temperature was 200° C., and the pressure bonding period of time was 60 min. In this stage, the flow channel member 3 was compressed as in FIG. 3D because the flow channel member 3 was heated to a temperature of the glass transition temperature (180° C.) or higher and the pressure-bonding pressure was high, and the flow channel member 3 at a site at which the flow channel member 3 came in contact with the through-hole 21 in the deformation induction region 20 was deformed into a projecting shape along the shape of the through-hole. The pressure bonding temperature was measured with thermocouples arranged in the pressure-bonding rod 14 and the substrate stage 13. After the sample was pressurized, the pressure-bonding rod 14 was separated from the head substrate 30 to complete the pressure bonding process, and a droplet ejection head was produced as illustrated in FIG. 3E. Hereinafter, the droplet ejection head produced according to this manufacturing method is referred to as head A-1.

Examples 2 to 5

Droplet ejection heads of Examples 2 to 5 were produced in a similar way to that in Example 1, except that the pressure bonding temperatures were changed to 225° C., 238° C., 250° C. and 300° C., respectively. Hereinafter, the heads produced in Examples 2 to 5 are referred to as heads A-2 to A-5, respectively. In these Examples, the flow channel member 3 was compressed as in FIG. 3D, because the flow channel member 3 was heated to a temperature of the glass transition temperature (180° C.) or higher and a pressure-bonding pressure was high, and the through-hole 21 in the deformation induction region 20 was filled with the flow channel member 3.

Comparative Example 1

A droplet ejection head was produced as a Comparative Example, according to a conventional process illustrated in FIGS. 8A and 8B (the head is referred to as head B-1). The head B-1 was laminated with a thermocompression bonding machine similar to that in FIG. 5. A silicon substrate as a fixing member 10, an orifice plate 2 on which only an ejection orifice 4 was formed, and a head substrate 30 similar to that used for producing the head A-1 were stacked on a sample stage 13 which was heated to 180° C. In Comparative Example 1, no deformation induction region was formed in the orifice plate 2 and in a flow channel member 3. At that time, the fixing member 10, the orifice plate 2 and the head substrate 30 were aligned by an alignment mechanism of the thermocompression bonding machine (FIG. 8A). After that, the members were pressurized with a pressure-bonding rod 14 illustrated in FIG. 5 and were pressure-bonded. The pressure-bonding pressure was 0.015 MPa, the pressure bonding temperature was 180° C., and the pressure bonding period of time was 10 min. However, because a through-hole and a recess were not formed in the orifice plate and in the flow channel member as described above, plastic deformation of the flow channel member 3 did not occur under the pressure bonding conditions. In addition, any deformation of the flow channel member 3 was not observed after pressure bonding.

Comparative Example 2

A droplet ejection head (head B-2) was produced in a similar way to that in Example 1, except that an orifice plate 2 similar to that used for producing the head B-1 was used. In Comparative Example 2, no deformation induction region was formed in the orifice plate 2 and in the flow channel member 3, similarly to Comparative Example 1. The head B-2 was produced by pressure-bonding the members under the conditions that the pressure-bonding pressure was 0.2 MPa, the pressure bonding temperature was 200° C., and the pressure bonding period of time was 60 minutes, in a similar way to those in Example 1, but a deformation induction region was not formed in the orifice plate 2 and the flow channel member 3, as described above. Because of this, any deformation was not observed in the flow channel member 3 of the head B-2.

[Evaluation]

Figure 10:
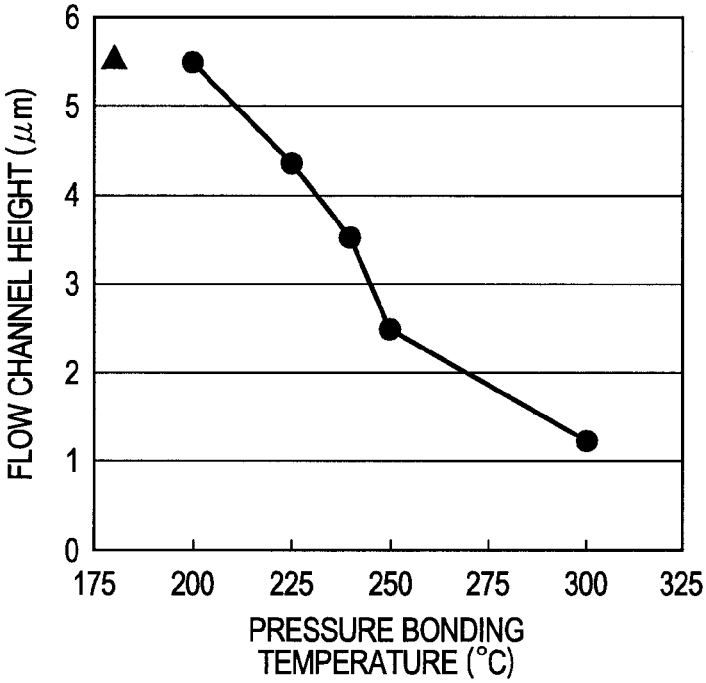
FIG. 10 is a view illustrating a relationship between a pressure bonding temperature and a flow channel height of the droplet ejection head.

FIG. 10 illustrates the relationship between the flow channel height in the vicinity of the ejection orifice 4 and the pressure bonding temperature, in heads A-1 to A-5 of the Examples and the head B-1 of Comparative Example 1. The flow channel height means the distance between the lower face of the orifice plate 2 (face on the side of the flow channel member) and the surface of the substrate 1, as is illustrated in FIG. 3E. The data for the head B-1 of the Comparative Example was plotted with a triangular symbol, and the data for the heads A-1 to A-5 of Examples were plotted with a circular symbols in the figure.

Figure 11:
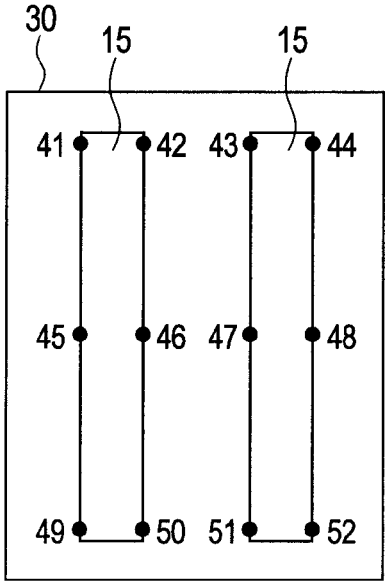
FIG. 11 is a plan view illustrating measurement positions of the flow channel height in the droplet ejection head.

The flow channel height was measured in the following way. FIG. 11 is a plan view of the head substrate 30 and illustrates the sites at which the flow channel height was measured. As illustrated in FIG. 11, the produced head had two rows of the ink supply ports 15 with a shape of a slender rectangle which were opened in parallel to each other. The flow channel heights at the sites denoted by reference numerals 41 to 52 were measured with a microscope, and the average value was calculated. Heater rows (not shown) are provided on both sides in the width direction of the ink supply port 15.

According to FIG. 10, in the heads produced in the Examples, the higher the pressure bonding temperature is, the lower the flow channel height is. In the head A-1 which was prepared by carrying out the pressure-bonding at a temperature of 200° C., the flow channel height is 5.1 μm which is slightly lower than 5.5 μm of the thickness of the flow channel member 3, and the flow channel member is deformed. In the heads A-2 to A-5 which were produced at pressure bonding temperatures of 225° C. or higher, the flow channel height was 5 μm or lower. When the heads were observed from above with a microscope, it was clearly confirmed that the orifice plate region on the ink flow channel 9 was dented.

Such a behavior that the flow channel height changes according to the pressure bonding temperature can be described in the following way. The behavior will be described on the basis of the data concerning the elastic modulus of the standard epoxy resin having a glass transition temperature of 180° C. When the pressure bonding temperature is in the range from room temperature to a temperature lower than 160° C., the epoxy resin is hard and its elastic modulus is 1 GPa or more. Because of this, when the flow channel member 3 is pressure-bonded under a pressure of 0.2 MPa, the amount of compression strain of the flow channel member 3 is 0.001 μm and the flow channel member 3 is hardly deformed. Before compression, the flow channel member 3 has a thickness of 5.5 μm.

However, when the pressure bonding temperature reaches 160° C. or higher, the elastic modulus of the epoxy resin begins to decrease significantly, and when the pressure bonding temperature reaches the vicinity of the glass transition temperature (180° C.), the elastic modulus of the epoxy resin decreases by 1 to 2 digits and decreases down to 0.1 GPa. In the present invention, at least one of the orifice plate and the flow channel member has a deformation induction region therein, and accordingly the flow channel member can be plastically deformed by being heated to the glass transition temperature or higher and being compressed in such a state that the elastic modulus is decreased to thereby cause the flow channel member to intrude into the above described region. As a result of this, a step as illustrated in FIG. 3E can be formed in the flow channel member.

In addition, the elastic modulus at a temperature (225° C.) of 1.25 times the glass transition temperature (180° C.) is 0.7 MPa, and when a pressure-bonding pressure of 0.2 MPa is applied to the flow channel member 3, the amount of the compression strain of the flow channel member 3 becomes as larger as 1.5 μm. In this case, a ratio of the amount of strain with respect to the thickness of the flow channel member becomes 27%. As a result of such a large distortion of the flow channel member 3, the flow channel member 3 can easily undergo plastic deformation, and the through-hole 21 on the deformation induction region 20 can be easily filled with the flow channel member 3. Then, the compressive stress of the flow channel member 3 is alleviated, and a two-stage step can be easily formed on the flow channel member 3.

Accordingly, it is considered to be more effective in forming a step in the flow channel member 3 that the pressure bonding temperature is set at 225° C. or higher, in other words, that the pressure bonding temperature is set at a temperature (° C.) of 1.25 times or more the glass transition temperature (° C.).

Figure 12:
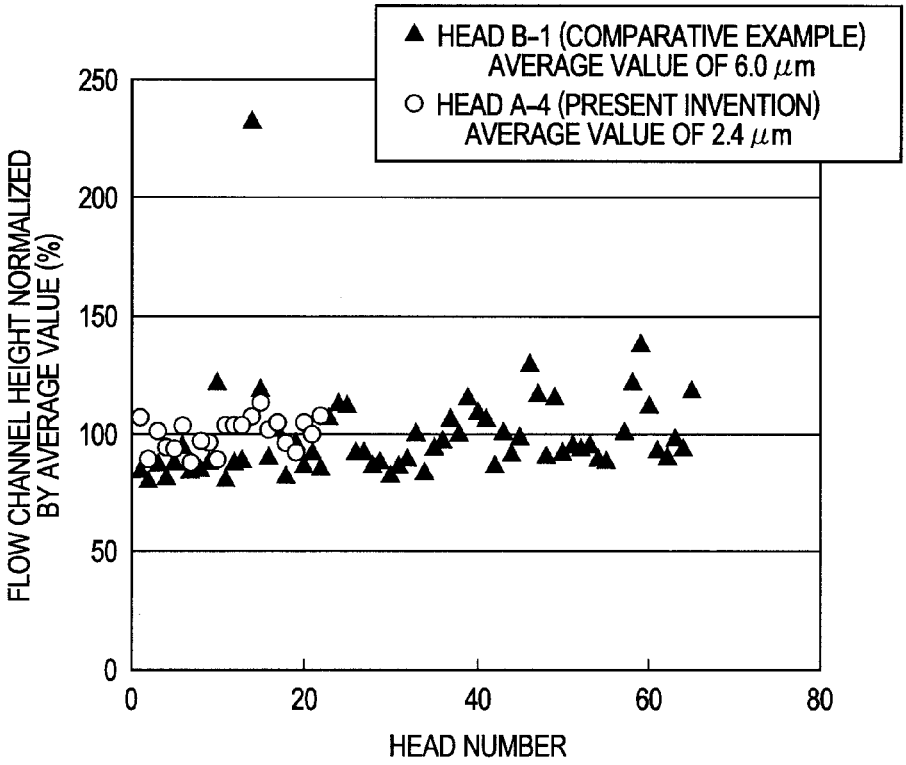
FIG. 12 is a view illustrating a relationship between the head number of the manufactured droplet ejection heads and the average height of the flow channel in the heads.

Next, the reproducibility of the flow channel height was examined on the head B-1 of Comparative Example and the head A-4 produced at a pressure bonding temperature of 250° C. The flow channel height of the head A-4 was 2.4 μm, and the thickness at the site in which the flow channel member 3 was thickest was 5.5 μm. As a result, a step of 3.1 μm was formed in the flow channel member 3. FIG. 12 is a plot showing the relationship between the head numbers of the head A-4 and B-1 produced according to the above described manufacturing method (Example 4 and Comparative Example 1) and the flow channel height (%) normalized by the average value. For the head B-1 produced according to the conventional manufacturing method, 65 pieces in total were produced, the average flow channel height of the 65 pieces of heads was 6 μm, and the dispersion (standard deviation/average value) was 22%. These 65 pieces of the head B-1 were denoted by head numbers 1 to 65 (heads B-1-1 to B-1-65), and the data were plotted with the triangular symbols in the figure. As for the head B-1, a head was occasionally produced in which the flow channel height was approximately 2 μm higher than the thickness of the flow channel member. As a result of having examined the flow channel height at points in a chip of the head with a head number 10 (head B-1-10, flow channel height of 7.4 μm) illustrated in FIG. 12 as such a defective head, it was found that the sites denoted by the reference numeral 48 and 49 in FIG. 11 were lifted by 2 μm or higher compared to the other sites and that local flexure occurred. The causes of the local flexure, in view of an orifice plate having a very small thickness of 3 μm used, is considered to include its deformation during manufacturing, flexure due to static electricity, and inadequate pressure-bonding uniformity.

On the other hand, for the head A-4 according to the present invention, 22 pieces in total were produced, the average value of the flow channel heights of the 22 pieces of heads was 2.4 μm, and the dispersion was 7%. These 22 pieces of the head A-4 were denoted by head numbers 1 to 22 (heads A-4-1 to A-4-22), and the data were plotted in the figure with the circular symbols. In the heads A-4, though the flow channel heights are low, none of the heads having an orifice plate having been locally lifted were found, and the dispersion of the flow channel heights was also small. This result is considered to show that the local flexure, occurring in a thin orifice plate, is effectively suppressed by the manufacturing method according to the present invention.

Subsequently, purified water was ejected from the head B-1 and the head A-4, and the minimum heater power necessary for the ejection was examined. When a pulse width of the voltage pulse was set at 1.2 μsec, the minimum heater power for the head A-4 was 0.75 times the minimum heater power for the head B-1. This is because the distance between the ejection orifice 4 and the heater in the head A-4 becomes approximately half times that in the head B-1, so that the energy for foaming is more effectively transmitted to the ejection orifice 4 side. Thus, in the heads produced according to the present invention, the flow channel height can be stably reduced, which is advantageous for lowering the power consumption as well.

In addition, the energy required for ejection is greatly changed by 0.75 times even when the variation in the flow channel height is only approximately 3 μm, which fact means that the speed and volume of the ejected ink droplets also greatly vary. A difference of 10 μm or more at the maximum between the flow channel heights (in other words, variation in the flow channel heights) as illustrated in the data for the head B-1 in FIG. 12 is considered to causes a large dispersion of the speed and volume of the ejected ink droplets in the chip. Furthermore, the direction of the droplets ejected from an ejection orifice in the vicinity of a flexed region of the orifice plate was deflected.

It was shown from the above results that the manufacturing method according to the present invention can prevent the occurrence of the flexure of the orifice plate and can stably reduce a gap distance between the ejection orifice and the energy-generating element even if the orifice plate is as thin as 3 μm.

Preferred aspects of the manufacturing method according to the present invention can be summarized in the following way. Firstly, the deformation induction region having at least one of the through-hole and the recess is provided in at least one of the flow channel member in the vicinity of the outer circumferential part of the liquid flow channel and also on the side nearer to the flow channel member than the outer circumferential part of the liquid flow channel, and the orifice plate located on the flow channel member. At least one of the above described through-hole and the recess is filled with the flow channel member by heating the flow channel member to a specific temperature of the glass transition temperature or higher of the flow channel member and pressure-bonding the orifice plate with the flow channel member. At this time, the compressive stress is alleviated in the vicinity of the outer circumferential part of the liquid flow channel of the flow channel member. When the pressurization is stopped, the flow channel member expands by virtue of a restoring force, and the flow channel member in the vicinity of the through-hole and the recess and the orifice plate are deformed into two stages. As a result of this, the orifice plate is more stretched in the plane, and the flexure of the orifice plate is easily resolved.

INDUSTRIAL APPLICABILITY

The droplet ejection head according to the present invention can be widely applied to various ejection mechanisms according to utilization forms, and which ejection mechanism is used in equipment that generates a predetermined flow of air under the atmospheric pressure, such as a printer and medical equipment including a liquid-medicine ejection apparatus.

EFFECT OF THE INVENTION

According to the present invention, the followings are provided. There are provided a droplet ejection head which can surely prevent the flexure of an orifice plate with a simple and easy structure, and can reduce an influence of the flexure of the orifice plate even when the plate thickness is decreased, and a gap between an energy-generating element and the plate is decreased, and a method for manufacturing the same.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-256863, filed Nov. 17, 2010, which is hereby incorporated by reference herein in its entirety.

What is claimed is:

1. A method for manufacturing a droplet ejection head, having a structure in which a substrate having energy-generating elements that impart energy to a liquid to eject liquid droplets from ejection orifices and an orifice plate having the ejection orifices formed therein are laminated through a flow channel member for forming a pattern of liquid flow channels in a region in which the liquid flows, wherein at least one of the orifice plate before being laminated and the flow channel member before being laminated has a plurality of voids of at least one of a plurality of through-holes other than the ejection orifices and a plurality of recesses in the face to be laminated, said method comprising the following steps in the listed order:

(1) applying a material for forming the flow channel member onto the substrate having the energy-generating element formed therein, and patterning the applied material to form the flow channel member;

(2) stacking the orifice plate on the flow channel member;

(3) heating the flow channel member to a glass transition temperature of the flow channel member or higher;

(4) collectively pressing the orifice plate and the flow channel member toward the face of the substrate, in a state of the flow channel member being kept at the glass transition temperature or higher, thereby compressing the flow channel member, and laminating the orifice plate with the flow channel member; and (5) stopping the pressing, wherein the orifice plate before being laminated has the plurality of voids, and when rectangles that surround each of the voids are defined to have centers which match with centers of the plurality of voids on the face to be laminated, respectively, and to have sides of the rectangles passing through middle points between each of the centers of the plurality of voids and each of the centers of adjacent other voids, in a portion of the orifice plate which is demarcated by a region that overlaps with the flow channel member when the orifice plate has been laminated, and the region in which all the rectangles corresponding to respective voids of the plurality of voids are connected, and a ratio of the total volume of the plurality of the voids contained in the portion of the orifice plate with respect to the volume of the portion of the orifice plate is 8.7% or more.

2. The method for manufacturing a droplet ejection head according to claim 1, wherein the plurality of voids is also provided in the flow channel member before being laminated.

3. The method for manufacturing a droplet ejection head according to claim 2, wherein in a portion of the flow channel member which is demarcated by a region in which all the rectangles corresponding to each void of the plurality of voids are connected, a ratio of the total volume of the plurality of voids contained in the portion of the flow channel member with respect to the volume of the portion of the flow channel member is 8.7% or more.

4. The method for manufacturing a droplet ejection head according to claim 1, wherein the flow channel member comprises an organic resin having photosensitivity.

5. The method for manufacturing a droplet ejection head according to claim 1, wherein the orifice plate comprises an inorganic material.

6. The method for manufacturing a droplet ejection head according to claim 5, wherein the inorganic material is at least one metal selected from the group consisting of nickel, palladium, gold, platinum, iron, tantalum, tungsten and stainless steel.

7. The method for manufacturing a droplet ejection head according to claim 1, wherein in step (3), the flow channel member is heated to a temperature (° C.) of 1.25 or more times the glass transition temperature (° C.) of the flow channel member.

8. The method for manufacturing a droplet ejection head according to claim 1, wherein the plurality of voids are formed in a direction perpendicular to the direction of arrangement of the ejection orifices.

9. A method for manufacturing a droplet ejection head having a structure in which a substrate having energy-generating elements that impart energy to a liquid to eject liquid droplets from ejection orifices and an orifice plate having the ejection orifices formed therein are laminated through a flow channel member for forming a pattern of liquid flow channels in a region in which the liquid flows, wherein at least one of the orifice plate before being laminated and the flow channel member before being laminated has a plurality of voids of at least one of a plurality of through-holes other than the ejection orifices and a plurality of recesses in the face to be laminated, said method comprising the following steps in the listed order:

(1) applying a material for forming the flow channel member onto the substrate having the energy-generating element formed therein, and patterning the applied material to form the flow channel member;

(2) stacking the orifice plate on the flow channel member;

(3) heating the flow channel member to a glass transition temperature of the flow channel member or higher;

(4) collectively pressing the orifice plate and the flow channel member toward the face of the substrate, in a state of the flow channel member being kept at the glass transition temperature or higher, thereby compressing the flow channel member, and laminating the orifice plate with the flow channel member; and (5) stopping the pressing, wherein the plurality of voids have a smaller diameter than that of the ejection orifices.

10. The method for manufacturing a droplet ejection head according to claim 9, wherein the plurality of voids are formed in a direction perpendicular to the direction of arrangement of the ejection orifices.

11. The method for manufacturing a droplet ejection head according to claim 9, wherein the orifice plate comprises an inorganic material.

12. The method for manufacturing a droplet ejection head according to claim 11, wherein the inorganic material is at least one metal selected from the group consisting of nickel, palladium, gold, platinum, iron, tantalum, tungsten and stainless steel.

13. The method for manufacturing a droplet ejection head according to claim 9, wherein in said step of heating, the flow channel member is heated to a temperature (° C.) of 1.25 or more times the glass transition temperature (° C.) of the flow channel member.

* * * * *